US006359549B1

(12) United States Patent
Lau et al.

(10) Patent No.: US 6,359,549 B1
(45) Date of Patent: Mar. 19, 2002

(54) ELECTRONIC SOUND GENERATOR WITH ENHANCED SOUND

(75) Inventors: Shek Fai Lau, Foster City; Richard J. Thalheimer, San Francisco; Edward C. McKinney, Jr., San Rafael; Tristan M. Christianson, San Francisco; Charles E. Taylor, Sebastopol, all of CA (US)

(73) Assignee: Sharper Image Corporation, San Francisco, CA (US)

( * ) Notice: Subject to any disclaimer, the term of this patent is extended or adjusted under 35 U.S.C. 154(b) by 0 days.

(21) Appl. No.: 09/669,995

(22) Filed: Sep. 25, 2000

(51) Int. Cl.[7] ..... G08B 3/10

(52) U.S. Cl. ..... 340/384.71; 340/384.72; 340/384.3; 381/118; 381/61; 381/94; 446/404; 446/484; 446/408

(58) Field of Search ..... 340/384.71, 384.72, 340/384.3; 381/118, 61, 94; 446/404, 484, 408

(56) References Cited

U.S. PATENT DOCUMENTS 4,744,281 A * 5/1988 Isozaki ..... 84/1.28
5,420,934 A * 5/1995 Okamoto ..... 381/118
5,619,179 A * 4/1997 Smith ..... 340/384.72
5,832,431 A * 11/1998 Severson et al. ..... 704/258

* cited by examiner

*Primary Examiner*—Daniel J. Wu
*Assistant Examiner*—Tai T. Nguyen
(74) *Attorney, Agent, or Firm*—Fliesler Dubb Meyer & Lovejoy LLP

(57) ABSTRACT

A sound generator includes a memory bank storing user-selectable recorded sounds, a microprocessor that can quasi-randomly time-delay at least one of the recorded sounds, and a mixer that can combine a user-selected recorded sound and the time-delayed sound for output by speakers or earphones. The microprocessor can also cause the output sound to include a microprocessor-selected one of the recorded sounds for inclusion during playback of a user-recorded sound.

2 Claims, 5 Drawing Sheets

ELECTRONIC SOUND GENERATOR WITH ENHANCED SOUND

FIELD OF THE INVENTION

The present invention relates generally to electronic generation of sound, and more specifically to methods and apparatuses that generate sound without generating obviously repetitive identical sound.

BACKGROUND OF THE INVENTION

Electronic sound generators are often used for personal entertainment, recreation, relaxation and even to promote sleep. Users of such equipment find the sound of rain, falling water, wind, among other natural sounds, to be especially beneficial. The sounds may be used to mask out excessively loud and distracting ambient noise, to soothe the user, and even to help the user fall asleep.

Electronic sound generators usually can create several such sounds, and include a switch permitting user-selection of a particular sound. The generators also provide controls for volume and even to permit the user to modulate the effects of some of the sounds.

Some electronic sound generators output synthesized sounds. The nature or other sounds will first have been tape recorded, and a digitized representation of the recorded sounds are then electronically stored in a synthesizer integrated circuit ("IC"). The IC is then used in an electronic sound generator to output the user-selected synthesized stored sounds for listening.

Other electronic sound generators do not store sounds, but simulate sounds using white noise. Ideally, a "white noise" generator outputs a wide spectrum of frequencies, each frequency component being of equal amplitude. Sounds associated with running or rushing water, for example, may be readily simulated using a white noise generator. The amplitude of the white noise is often modulated, or changed, using a ramp signal. When the instantaneous magnitude of the ramp varies, the magnitude of the white noise sound will be varied. A control can permit the user to vary varying the rate at which the ramp changes amplitude to produce interesting sound effects from white noise electronic sound generators.

Whether generated from a single digital synthesizer IC, or from a single white noise source, electronic sound generators present the sound to left and right channel speakers or earphones. This can somewhat improve the sound quality perceived by the user, but nonetheless there is considerable room for improvement. The sounds often sound too "flat", with too little perception of sound depth or quality. U.S. Pat. No. 5,619,179 (April 1997) to Smith and assigned to the assignee herein discloses a sophisticated method for electronically enhancing the perceived spatial separation of electronically generated sound. Applicants refer to and incorporate herein by reference said '179 patent to Smith, for background material.

One problem associated with many electronic sound generators is the somewhat limited repertoire of sounds that are provided and the all too perceivable sensation that the exact same sounds are simply being repeated over and over and over. A listener who selects "raindrop" sounds from an electronic sound generator repertoire soon becomes bored with the generator because after a few seconds, the listener can almost predict what sequence of raindrops falling will be heard next. The sound patterns simply become too repetitious for listening enjoyment or relaxation.

In some sound generators, variations in the sounds heard may occur too abruptly. Portions of an ocean wave sound, for example, may transition too abruptly from a quiet and calm wave sound to a loud rushing wave sound. The sensation can be a soft-loud-soft-loud repetitive pattern that is annoying to the user. In fact, some sound patterns that are too repetitively abrupt are believed to trigger seizures in epileptics.

In summation, there is a need for an electronic sound generator that can produce sounds whose patterns are not precisely repetitive to where a listener can essentially predict the next sequence in the sound. Such generator should provide a greater variety of perceived sound patterns, including patterns not readily recognizable by a listener as having been heard before.

The present invention provides such an electronic sound generator.

SUMMARY OF THE INVENTION

The present invention reproduces sounds electronically using at least one multi-channel sound integrated circuit (IC). Normally, within the IC different sounds are stored for reproduction through one or two audio channels (e.g., loud speakers). The present invention recognizes that the same stored sound is playable through more than one channel at a time, including playing through more than one channel with time delays. Further, different sounds may be played from different channels and then mixed and output through a single audio channel.

In this fashion, a stored digital sound of raindrops may be combined with itself, but with a time delay, to vary the perceived pattern. Further, the raindrop sound may be combined with a segment or "snippet" of other sounds, a bird chirping, for example, to vary the pattern from one playing to another.

Other features and advantages of the invention will appear from the following description in which the preferred embodiments have been set forth in detail, in conjunction with the accompanying drawings.

DETAILED DESCRIPTION OF THE PREFERRED EMBODIMENTS

Figure 1:
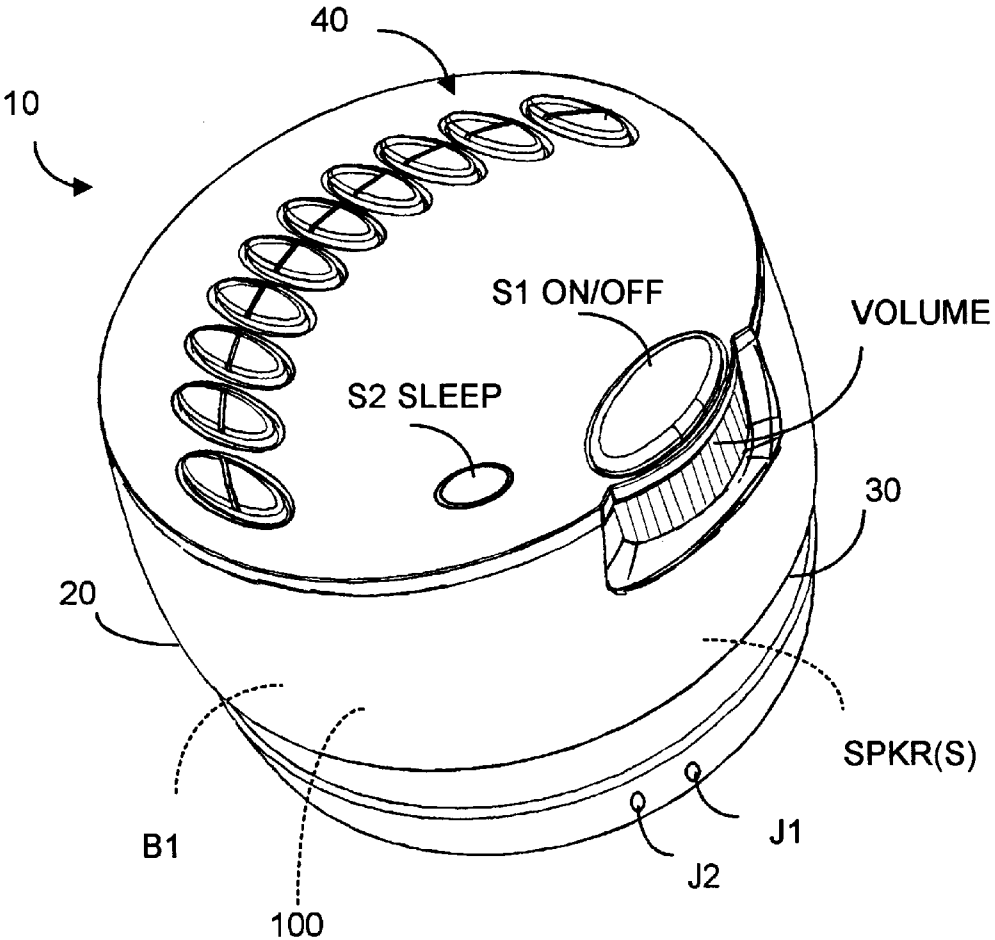
FIG. 1 is a front view of an electronic sound generator with enhanced sound, according to the present invention.

FIG. 1 depicts an electronic sound generator 10 with enhanced sound, according to the present invention The preferred embodiment is disposed within a somewhat cylindrical-shaped housing 20 that has a recess area 30 with openings (not shown) from which audible sound generated within by one or more speakers (SPKR(s)) may be heard by a user.

Along the top of the housing are several user-controls 40 for selecting particular sounds, e.g., city sounds, roadside sounds, a steam train engine, ocean tide sounds, foghorn sound, dockside sounds, oceanside sounds, surf sounds, rain sounds, brook sounds, waterfall sounds, rainforest sounds, forest sounds, thunderstorm sounds, everglade sounds, campfire sounds, windchimes, summer night sounds, bird sounds, and heartbeat sounds. Of course a different repertoire of sounds could be provided by generator 10, including a greater or less number of sounds.

Also available to the user are various switch controls including an ON/OFF switch S1 for generator 10, a sleep switch S2 that causes sound generator 10 to turn-off after a predetermined time, e.g., 30 minutes, and a volume control (VOLUME) to control volume of the generated sound.

Within housing 20 are disposed electronics 100 implementing sound generation according to the present invention, as well as a battery power source B1, although DC operating power, e.g., 6 VDC to perhaps 9 VDC, may be generated externally and input to device 10 via input jack J1. One or more loud speakers (SPKR(s)) are disposed within the housing, and an earphone jack J2 permits disabling speaker output in favor of stereophonic audio available to earphones that are connected to J2.

Figure 2A:
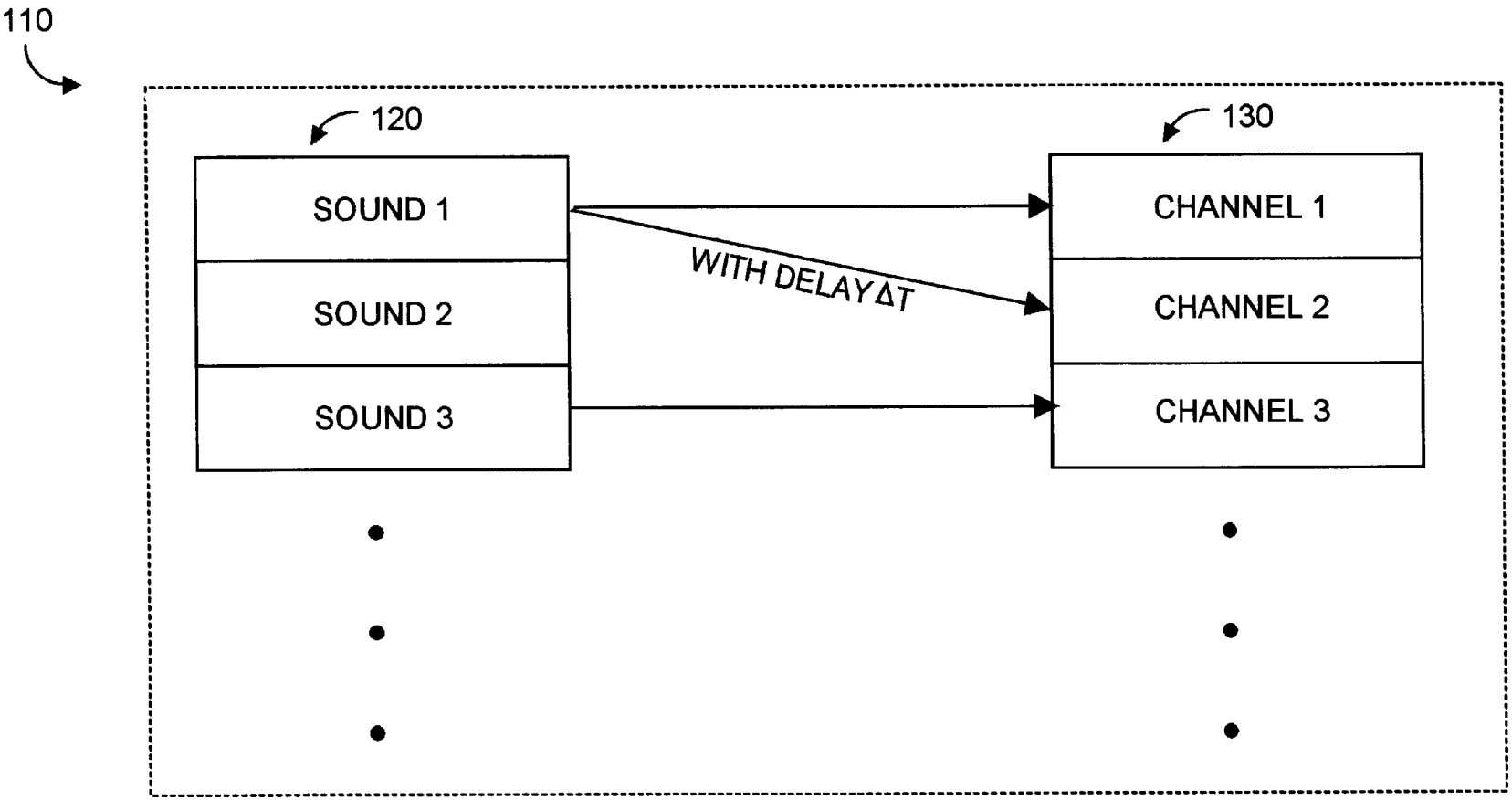
FIG. 2A is a block diagram depicting use of sound files in a multi-channel IC, according to the present invention.

FIG. 2A depicts a generic multi-channel integrated circuit (IC) chip 110 having a register memory 120 in which are stored a plurality of digitized sounds. Sound 1 may, for example, be city sounds, Sound 2 may be road side sounds, Sound 3 may be steam engine train sounds, and so forth. The stored sounds may have been generated by digitizing authentic sounds, or they may have been synthesized, or perhaps some sounds were digitally recorded and other sounds synthesized. The various sounds in memory 120 are accessible to the various audio channels 130 that are also provided within IC 110. A given sound may be played through more than one channel at the same time, or through more than one channel using time delays in one or more channels. Thus, Sound 1 is shown being coupled to Channel 2 and, with a time delay, also being coupled to Channel 2. Sound 3 is shown being coupled directly to Channel 3. If desired, different sounds can be played from different channels, and then mixed together for output via a common loudspeaker.

Figure 2B:
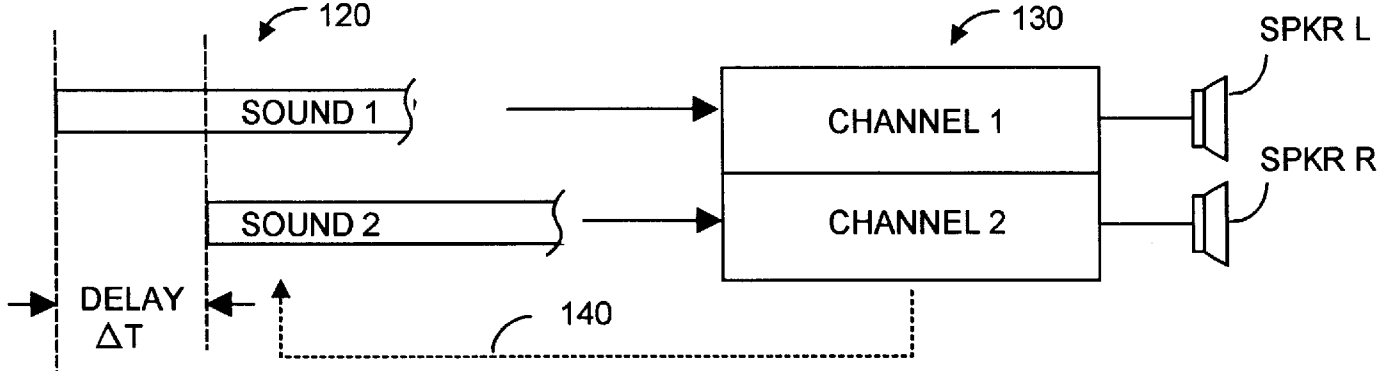
FIG. 2B is a further block diagram depicting use of sound files in a multi-channel IC, according to the present invention.

The configuration of FIG. 2B is used in the present invention to impalement a pseudo-stereo sound. In FIG. 2B, the same sound, e.g., Sound 1 from a common storage address in memory register 120 is played through two audio channels, but with a time delay Δt intentionally inserted in one of the sound paths, here the input to Channel 2. With Δt equal to a few milliseconds, a reasonably sounding stereo effect can be achieved, especially when the generated sound is heard through stereophonic earphones coupled to input jack J2 of device 10. As noted by optional feedback path 140, the selected channel(s) of audio may be looped back, using techniques known in the art of synthetic sound generator design.

Figure 2C:
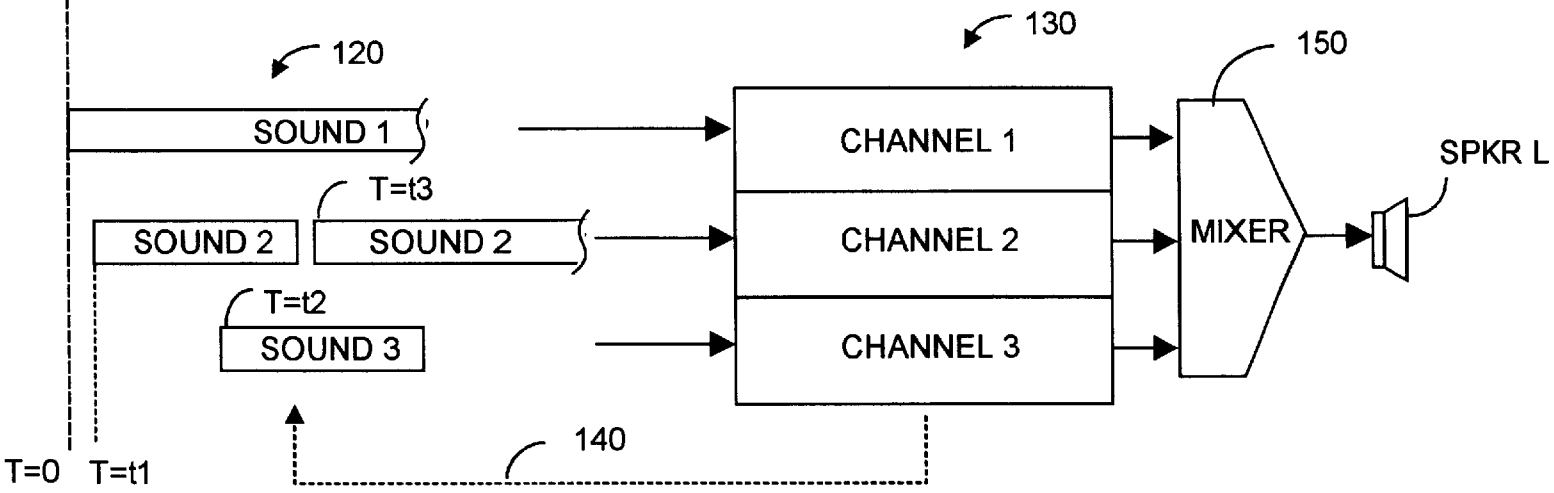
FIG. 2C is a block diagram depicting a preferred use of multiplexed sound files from a multi-channel IC, according to the present invention.

An even more sophisticated use of multi-channel IC 110 is depicted in FIG. 2C, wherein "snippets" or sound segments may be combined to generate different combinations of sound. In FIG. 2C, Sound 1 (assume Sound 1 is city sounds) is coupled to Channel 1. However a time delay Δt1 later, Sound 2 (assume roadside sounds) is coupled to Channel 2. At delay time Δt2, Sound 3 (assume steam train sounds) is coupled to Channel 3. At delay time Δt3 Sound 2 (roadside sounds) is again presented to Channel 2. The channel outputs, here three channels of audio, are then mixed with mixer 150 and output to a speaker, here the left speaker (if left and right speakers are used) or left earphone audio. The sound heard by a user would start out as city sounds (e.g., perhaps pedestrian noise), and after Δt1 roadside sounds would be added (perhaps a car horn sounding), then after Δt2 a steam engine sound might be heard, and after Δt3 roadside sounds would again be heard. In the preferred embodiment, the various time delays are quasi-randomly within device 10, and indeed ancillary sounds appropriate for inclusion with primarily selected sounds may be selected by device 10. While the above description is exemplary, it will be appreciated that a wide variety of sounds may thus be generated, so many sound combinations that the listener is unlikely to "recognize" sound sequences as being exactly identical to previously heard sound sequences. This aspect of the present invention is quite unlike prior art sound generators in which the exact same sound sequences are played to the point where the sound sequences are almost memorized by listeners, who rapidly grow tired of listening.

Figure 3A:
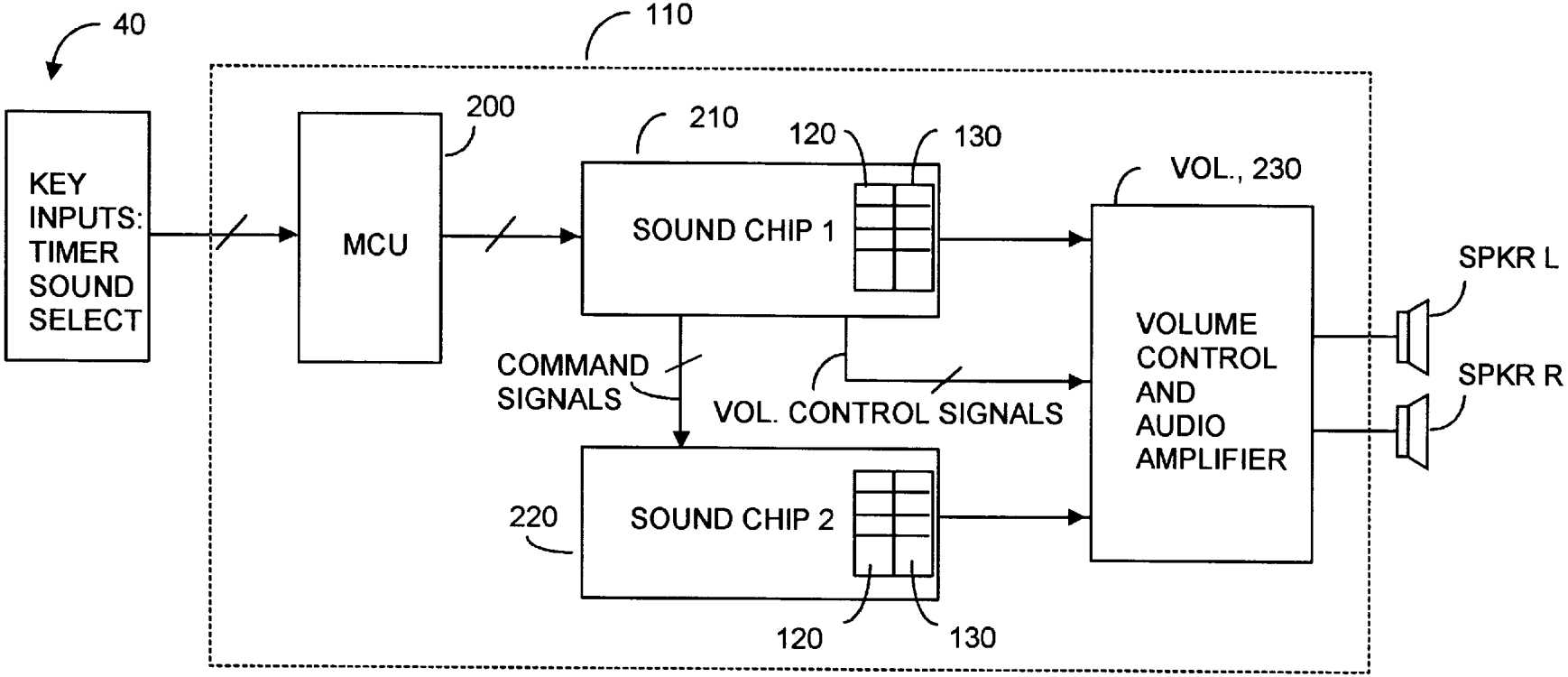
FIG. 3A is a block diagram of the preferred implementation of FIG. 2C, according to the present invention.

The diagram of FIG. 3A will now be understood in view of the foregoing descriptions. Using various controls on device 10, a user can select certain sounds and times, for example by pushing control buttons to select foghorn sound, waterfall sound, windchimes sound, and perhaps pushing the sleep button to turn-off the device after a predetermined time period. A central processor unit or microcontroller unit 200 receives the user input and can intelligently augment sound selections by selecting appropriate ancillary sounds. Thus, if foghorn sounds were selected, MCU 200 can decide that some random period Δt1 into the playing of foghorn sounds that surf sounds may begin to be played as well, since surf sounds and foghorn sounds can previously have been associated within memory in MCU 200.

MCU 200 issues command signals to a master sound chip 1 210, that contains its own sound and channel registers 120, 130. Sound chip 1 then issues command signals to a slave sound chip 2 220, that contains its own sound and channel registers 120, 130. The master and slave sound chips 210, 220 output their respective audio signals to an audio amplifier unit 230, and master sound chip 1 also outputs common volume control signals to unit 230 as well. Associated within unit 230 can be mixer 150. Unit 230 preferably outputs two channels of audio, e.g., to left and right speakers and/or to left and right earphone channels.

Figure 3B:
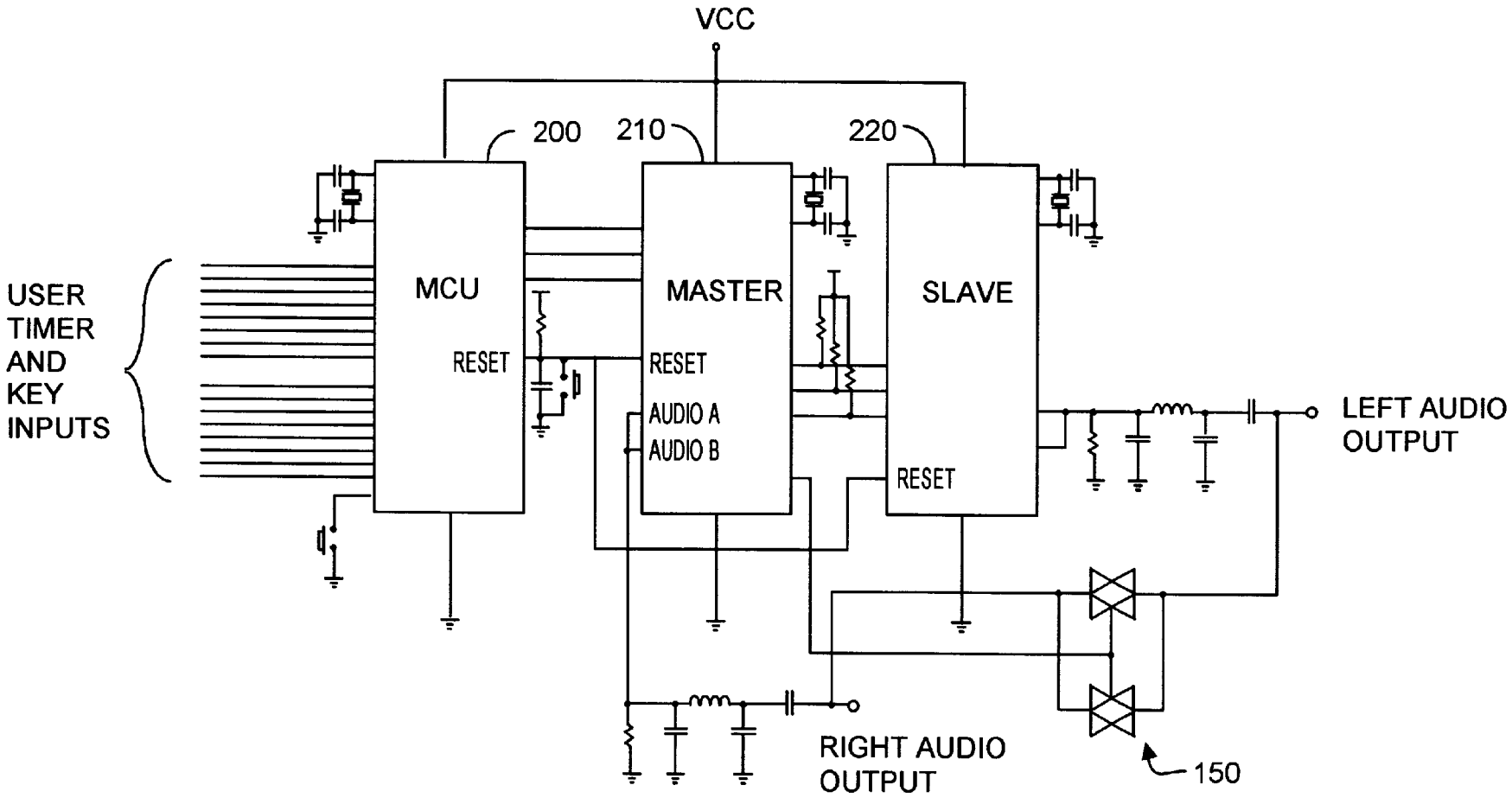
FIG. 3B is a simplified schematic of the sound generator portion of the present invention.

FIG. 3B is a schematic of the preferred implementation and follows the general block diagram of FIG. 3A, except that the mixer unit 150 is explicitly shown.

Modifications and variations may be made to the disclosed embodiments without departing from the subject and spirit of the invention as defined by the following claims. For example, although the present invention had been described with respect to a stand-alone sound generator, the invention could be incorporated into other electronic devices, for example, a CD player, a radio, etc.

What is claimed is:

1. An electronic system for generating sound on a first sound channel and on a second sound channel, comprising:

a memory bank storing user-selectable recorded sounds;

means for quasi-randomly time-delaying at least one of said recorded sounds;

means for automatically selecting a second sound associated with a user-selected sound;

means for combining at least one user-selected recorded sound, at least one time-delayed version of one of said recorded sounds, and at least one said second sound; and at least one audio output transducer for playing a combination of the user-selected recorded sound, the time-delayed version of one of said recorded sounds, and the second sound.

2. An electronic system for generating sound on a first sound channel and on a second sound channel, comprising:

a memory bank storing user-selectable recorded sounds;

means for quasi-randomly time-delaying at least one of said recorded sounds;

a second sound associated with a user-selectable sound automatically selected by a microprocessor;

means for combining at least one user-selected recorded sound, at least one time-delayed version of one of said recorded sounds, and at least one second sound; and at least one audio output transducer for playing a combination of the user-selected recorded sound, the time-delayed version of one of said recorded sounds, and at least one second sound.

* * * * *